US005698269A

United States Patent [19]

Carlblom et al.

[11] Patent Number: 5,698,269

[45] Date of Patent: Dec. 16, 1997

[54] ELECTROSTATIC DEPOSITION OF CHARGED COATING PARTICLES ONTO A DIELECTRIC SUBSTRATE

[75] Inventors: Leland H. Carlblom, Richland Twp., Allegheny County; Donald B. Jones, Wildwood; Ken W. Niederst, Hampton Twp., Allegheny County; Paul S. Chirgott, Moon Twp., Allegheny county, all of Pa.

[73] Assignee: PPG Industries, Inc., Pittsburgh, Pa.

[21] Appl. No.: 574,758

[22] Filed: Dec. 20, 1995

[51] Int. Cl.[6] ..... B05D 1/06; B05D 3/14

[52] U.S. Cl. ..... 427/475; 427/485; 427/486; 427/533

[58] Field of Search ..... 427/475, 476, 427/483, 485, 486, 533

[56] References Cited

U.S. PATENT DOCUMENTS

| | | | |
|---|---|---|---|
| 1,855,869 | 4/1932 | Pugh . | |
| 2,247,963 | 7/1941 | Ransburg et al. . | |
| 2,334,648 | 11/1943 | Ransburg et al. | 117/17 |
| 2,662,833 | 12/1953 | Helmuth . | |
| 2,710,773 | 6/1955 | Sedlacsik . | |
| 3,413,917 | 12/1968 | Fisher et al. | 118/626 |
| 3,462,292 | 8/1969 | Turner | 427/566 |
| 3,521,558 | 7/1970 | Fisher et al. | 101/114 |
| 3,741,793 | 6/1973 | Simmons | 117/93.4 |
| 3,854,439 | 12/1974 | Harmuth | 118/4 |
| 4,088,093 | 5/1978 | Pan | 118/630 |
| 4,099,486 | 7/1978 | Bialorucki et al. | 118/635 |
| 4,110,486 | 8/1978 | Lacchia | 427/462 |
| 4,230,068 | 10/1980 | Itoh et al. | 118/634 |
| 4,319,543 | 3/1982 | Shank | 118/503 |
| 4,323,197 | 4/1982 | Morishita et al. | 239/703 |
| 4,368,853 | 1/1983 | Morishita et al. | 239/703 |
| 4,377,603 | 3/1983 | Itoh et al. | 427/462 |
| 4,384,682 | 5/1983 | Sugiyama et al. | 239/703 |
| 4,625,854 | 12/1986 | Deichmann et al. | 198/416 |
| 4,640,403 | 2/1987 | McDermott | 193/34 |
| 4,640,406 | 2/1987 | Willison | 198/377 |
| 4,844,348 | 7/1989 | Rutz | 239/703 |
| 4,927,205 | 5/1990 | Bowler et al. | 294/94 |
| 5,518,546 | 5/1996 | Williams et al. | 118/621 |
| 5,532,097 | 7/1996 | Tavernier et al. | 430/110 |

FOREIGN PATENT DOCUMENTS

| | | |
|---|---|---|
| 0 297 520 | 1/1987 | European Pat. Off. . |
| 0 253 026 | 1/1988 | European Pat. Off. . |
| 25 17 504 A1 | 7/1976 | Germany . |
| 35 08 968 C2 | 3/1985 | Germany . |
| 3600065 A1 | 3/1986 | Germany . |
| 2189412 | 10/1987 | United Kingdom . |

OTHER PUBLICATIONS

Dr. R. Brück, Leverkusen, "Chemical constitution and electrostatic properties of polymers", Translated from Kunststoffe 71 (1981) 4, pp. 234/239, English translation pp. 12–14.

Gerald L. Schneberger, General Motors Institute, Flint MI, "Understanding Paint and Painting Processes" Second Edition, Industrial Finishing, Hitchcock Publishing Company, pp. 69–89. No date.

Douglas M. Considine, P.E., Glenn D. Considine, Van Nostrand's Scientific Encyclopedia, Seventh Edition, Van Nostrand Reinhold, New York. No date.

(List continued on next page.)

*Primary Examiner*—Michael Lusignan
*Assistant Examiner*—Fred J. Parker
*Attorney, Agent, or Firm*—Paul S. Chirgott

[57] ABSTRACT

This invention provides a process for electrostatically applying a coating composition onto dielectric materials which have a dielectric constant less than 4.0. In this process, a positive charge is induced onto a coating composition. The dielectric material is electrically isolated, negatively charge, or both. The positively-charged coating composition is sprayed onto the dielectric material. If the dielectric material is charged negatively, the process of the present invention further includes the step of maintaining at least a portion of the negative charge on the dielectric material while positively-charged coating particles are being sprayed thereon.

14 Claims, 7 Drawing Sheets

OTHER PUBLICATIONS

Fred Little, "Today's Electrostatic Equipment for Tomorrow's coatings", Graco, Minneapolis, MN, Aprl. 1979 Products Finishing pp. 55–59.
Emery P. Miller, "Electrostatic Coating", Ransburg Corp., Indianapolis, IN pp. 251–281. Jun.–Jul. 1964.
Karl Sittel, "Electrostatic Deposition Process", Apr. 1960, pp. 288 thru 293.
Jim Van Heule, "The Basics of Spray Application", Surviving to 2000 & Beyond, Mar. 1994, pp. 22 thru 25.
Norman R. Roobol, "Industrial Painting: Principles and Practices", 1991, Hitchcock Publishing Co., Carol Stream, IL, pp. 145 thru 169.
Emery P. Miller and Lester L. Spiller, "Electrostatic Coating Process (Part I and Part II)", Ransburg Electro–coating Corp., Indianapolis, IN Reprinted from Paint and Varnish Production, Jun., Jul. 1964.
"Electrostatics General Information", DeVilbiss Ransburg, Industrial Liquids Systems, pp. 2 thru 29. No date.
C. Fred Little, "Equipment Options For Applying Environmentally Acceptable Coatings", GRACO Inc., Minneapolis, MN, pp. 290 thru 294 Feb. 12–14, 1979.
Bob Wettermann, "Plastic Finishing and Static", Tantec, Industrial Finishing, Feb. 1993, pp. 23 thru 25.
David P. Garner & Alaa A. Elmoursi, "Electrostatic Painting of Plastics I: Electrical Properties of Plastics and Primers", General Motors Research Laboratories, Journal of Coatings Technology, vol. 63, No. 803, Dec. 1991, pp. 33 thru 37.
Alaa A. Elmoursi & David P. Garner, "Electrostatic Painting of Plastics II: Electric Field Effects", General Motors Research Laboratories, Journal of Coatings Technology, vol. 64, No. 805, Feb. 1992 pp. 39 thru 44.
Nasreddine Bouguila, Roland Coelho, and Didier Navarre, "Electrostatic Painting of Insulating Surfaces", IEEE Transactions on Industry Applications, vol. 29, No. 4, Jul./Aug. 1993, pp. 798 thru 801.

ELECTROSTATIC DEPOSITION OF CHARGED COATING PARTICLES ONTO A DIELECTRIC SUBSTRATE

FIELD OF THE INVENTION

This invention relates to the art of electrostatically coating dielectric materials. In particular, this invention pertains to methods for controlling the pattern of a spray of finely divided, charged coating particles projected toward an electrically-isolated and/or oppositely-charged dielectric material.

BACKGROUND OF THE INVENTION

For a number of years, the finishing industry has used electrostatic methods as a means of improving the application efficiency of air atomizing spraying devices. Since the introduction of electrostatic spraying practices, they have been modified, and the equipment associated therewith improved, in an effort to increase application efficiency.

Behind the operation of all electrostatic spraying practices is the fundamental principle that oppositely charged bodies attract one another. Therefore, charged paint particles would be attracted towards a grounded or oppositely-charged article.

In electrostatic spraying practices, since the article being coated is the collecting electrode, it should have sufficient electrical conductivity, either through its bulk or across its surface, to carry away the electrical charge arriving on the surface with the accumulating paint particles. For this reason, electrostatic spraying practices are most often used to coat objects which are natural conductors of electricity (e.g., metals).

Typically, such conductive articles are held at a grounded potential by merely being supported from a grounded conveyor with a metal hook. By induction from the charging electrode, the conductive article assumes an electrical charge which is opposite to that of the charged paint particles. Accordingly, the electrically conductive article attracts the charged paint particles.

Notwithstanding the above, electrostatic painting practices are also used to coat articles made from non-conductive or dielectric materials (e.g., plastics, glass, ceramics, wood, etc.), hereinafter collectively referred to as "dielectric materials." When used for these purposes, it becomes necessary to make the dielectric material either permanent or temporary electrical conductors. A number of techniques have been attempted to accomplish this objective.

For example, molded rubber steering wheels are not natural conductors of electricity. However, they can be made electrically conductive by heating them to temperatures of at least about 212° F. (100° C.).

While this practice works well for electrostatically coating some dielectric materials, it has a number of problems associated therewith. For example, this practice cannot be used to induce a charge on those dielectric materials which do not become electrically conductive when heated (e.g., wood). Moreover, this practice also cannot be used to induce a charge on those dielectric materials which begin to deform or degrade at or below the temperature needed to make them electrically conductive.

Another method of electrostatically spraying a dielectric material consists of coating the material with an electrically conductive primer. This practice is used in the coating of toilet seats. Specifically, toilet seats are normally made from a phenolic resin/wood-flour mixture. This material is non-conductive and does not become conductive upon heating. Accordingly, to make it possible to electrostatically coat these items, the seats are first dipped into an electrically conductive, film forming primer which contains a considerable amount of carbon black. When dried, this coating creates an electrically conductive film on the surface of the seat. After being coated with this primer, the seats are supported from a grounded conveyor with metal hooks. Thereafter, the top coat is electrostatically applied.

While this practice works well for electrostatically coating some dielectric materials, it also has a number of problems associated therewith. For example, the aforementioned electrically conductive primer contains a large amount of carbon black. Therefore, it cannot be used to induce a charge on a dielectric material if the final coated article needs to be clear or transparent. Moreover, when employing this practice there is also an increase in not only raw material costs, but also production time.

U.S. Pat. No. 2,622,833 disclosed a process and apparatus for electrostatically coating the exterior surfaces of hollow articles made from a dielectric or non-conductive material without the use of backing electrodes which conform to the shape of the article. In that patent, the articles being coated are mounted onto spindles which are connected to a conveyor system. The conveyor and the spindles are electrically conductive. Moreover, they are both connected, through a conductor, to either a ground or a power supply.

In U.S. Pat. No. 2,622,833, a conductive probe, which has an ionizing point or points, is electrically connected to the spindles. This probe is positioned so that it passes, through the article's opening, into the cavity of the article being coated. The spindles then carry these articles between oppositely disposed, spaced negatively-charged electrodes. As the articles pass therebetween, an electrostatic field is created between the negatively-charged electrodes and the exterior surface of the article. One or more spray guns are directed so as to introduce an atomized coating composition in a direction generally parallel to the path of travel of the articles into the space between the articles and the electrodes. As the paint particles enter into the ionizing zone, the accept a negative charge and are thus drawn to the grounded or positively-charged article.

U.S. Pat. No. 4,099,486 also discloses a process and apparatus for electrostatically coating glass bottles by using a particular chuck for supporting the bottles which is designed to prevent build-up of coatings thereon. That patent induces a charge onto the glass bottles by heating them to a temperature ranging between 150° F. (66° C.) to 450° F. (232° C.).

According to U.S. Pat. No. 4,099,486, the supporting chuck is made from a non-conductive plastic. This chuck fits over a grounding plug which is designed to ground the bottle by being in physical contact therewith. For example, one embodiment of a ground plug described in that patent is in the form of a flat-headed probe upon which rests the neck of the bottle. Another embodiment of a ground plug described in that patent is in the form of a flat-ended rod which extends into the bottle's opening, and through the bottle's entire length, until the distal end of the rod contacts the inside surface of the bottle's base. Yet another embodiment of a ground plug described in that patent is in the form of a flat-ended rod whose outside dimension is parallel to the inside dimension of the bottle's opening. With this latter configuration, when the ground plug is inserted into the bottle's opening, the outside walls of the plug contact the inside walls of the bottle's neck.

Notwithstanding the above, the finishing industry is continually looking for electrostatic spraying processes which increasing transfer efficiencies. Obviously, as transfer efficiencies increase, waste (i.e., overspray) decreases. This, in turn, reduces raw material costs. Accordingly, processes which have improved transfer efficiencies are highly sought after by those in the finishing industry.

SUMMARY OF THE INVENTION

Accordingly, one object of this invention is to provide processes which have improved transfer efficiencies, and which are designed for electrostatically coating dielectric materials without having to first heat the materials or coat them with an electrically-conductive, film-forming primer.

This and other objects are achieved through the discovery of a novel process for electrostatically applying a coating composition onto dielectric materials which have a dielectric constant less than 4.0. In this novel process, a positive charge is induced onto a coating composition. The dielectric material is electrically isolated and/or has a negative charge induced thereon. The positively-charged coating composition is sprayed into the vicinity of the isolated and/or negatively-charged dielectric material. If the dielectric material is electrically isolated, the process of the present invention preferably includes positioning a grounding device such that it is in the path of the sprayed, positively-charged coating particles but shielded therefrom by the electrically isolated dielectric material. On the other hand, if the dielectric material is negatively charged, the process of the present invention includes maintaining at least a portion of the charge on the dielectric material while the positively-charged coating particles are applied thereon.

A more complete appreciation of the present invention, and many of the attendant advantages thereof, will be readily ascertained as the invention becomes better understood by reference to the following Detailed Description when considered with the accompanying Figures briefly described below.

DETAILED DESCRIPTION OF THE INVENTION

Figure 1:
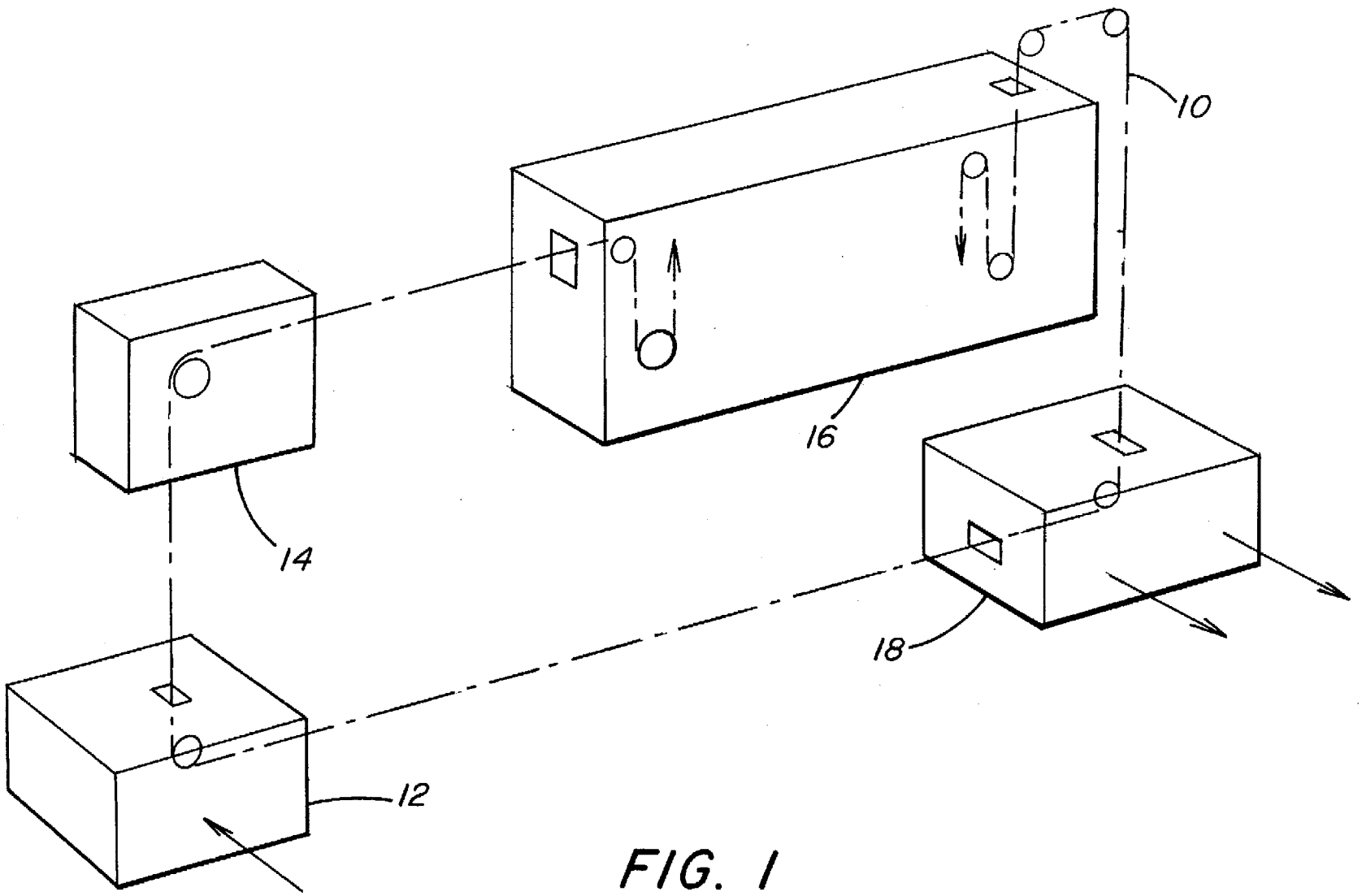
FIG. 1 is a schematic block diagram of an apparatus designed to transfer, electrostatically coat, cure, and discharge dielectric articles on a continuous conveyer system.

The present invention pertains to a novel process for electrostatically applying a positively-charged coating composition onto a particular class of dielectric materials which are electrically isolated and/or negatively-charged. The class of dielectric materials which can be coated in accordance with this invention are those materials which have a dielectric constant (k) less than 4.0. Preferably, the dielectric materials used when practicing this invention have a dielectric constant less than about 3.8, more preferably, less than about 3.6, and even more preferably, less than about 3.4.

Examples of dielectric materials suitable for use when practicing this invention include: fused silica, methylmethacrylate, polycarbonate, polyvinyl chloride, polyvinyl acetate, polyethylene terephthalate, polystyrene, polyethylene, polypropylene, polyethylene naphthalate and polytetrafluoroethylene, and mixtures thereof. This invention works particularly well for electrostatically coating dielectric materials selected from the group consisting of: polyvinyl chloride, polyvinyl acetate, polyethylene terephthalate, polystyrene, polyethylene, polyethylene naphthalate, polypropylene and polytetrafluoroethylene, and mixtures thereof.

In accordance with the novel process of the present invention, a positive charge is induced onto a coating composition. There are many different charging devices which can induce a positive charge onto a coating composition. Any of these devices can be used when practicing this invention. Examples of such coating charging devices include: (a) air and airless spray guns with either an internal charging electrode (i.e., induces a charge on the coating prior to spraying), or an external charging electrode (i.e., induces a charge on the coating after spraying), and (b) rotational spray guns having an electrically-charged rotating disc, bell or cone. The preferred coating charging device depends upon parameters such as the type of coating being applied (e.g., liquid or powder), the viscosity of the coating, the desired finish, the shape of the dielectric article, and the like. After taking these and other related parameters into consideration, those skilled in the art can select the coating charging device which best suits their needs.

In addition to inducing a positive charge on the coating, the dielectric material is electrically isolated and/or has a negative charge induced thereon. Preferably, the dielectric material is electrically isolated and charged negatively.

If a negative charge is induced onto a dielectric material in accordance with a preferred embodiment of this invention, there are many different charging devices which can achieve this objective. Any of these devices may be used. Typically, the dielectric material charging devices induce a negative charge thereon by directly contacting the dielectric material, ionizing the air in and/or around the dielectric material, or both. Examples of suitable dielectric material charging devices which can be used when practicing this embodiment of the invention include: charging bars, plates, wires, probes and/or a combination thereof.

The charging effect of the dielectric material charging device can be enhanced by having the charge is emitted through a number of sources. For example, a charge emitted from a flat plate could be enhanced if the plate had protruding therefrom a number of bumps or needle-like projections. Similarly, a charge emitted from a smooth surfaced probe could be enhanced if the probe had a number of wires or screw-like projections protruding therefrom.

The preferred dielectric material charging device depends upon parameters such as the composition and geometric shape of the dielectric material, the distance between the charging device and the dielectric material, if any, and the strength of the charge emitted from the charging device. After taking these and other related parameters in to consideration, those skilled in the art can select the dielectric material charging device which best suits their needs.

If a negative charge is induced onto a dielectric material in accordance with a preferred embodiment of this invention, the dielectric material charging device should induce a negative charge onto the dielectric material which is strong enough to attract positively-charged coating particles thereto. The preferred strength of the charge induced on the dielectric material depends upon parameters such as the strength of the charge induced on the coating particles, the velocity of the sprayed coating particles and the distance between the end of the coating atomizer and the dielectric material. After taking these and other related parameters in to consideration, those skilled in the art can select the strength of the charge to be induced onto the dielectric material which best suits their needs.

Moreover, the negative charge induced onto a dielectric material in accordance with this embodiment of the invention is typically at least about −100 volts (−0.1 KV), preferably, at least about −1.0 KV, and more preferably, at least about −2.0 KV. The upper limit of the charge induced onto the dielectric material in this embodiment of the invention is limited by considerations such as safety and practicality. For example, at a certain threshold voltage, an electric arc can result between the negatively-charged dielectric material and grounded or positively charged items such as: a spraying booth, a conveyor and spray guns. Accordingly, if a negative charge is induced onto a dielectric, the charge is preferably less than about −15,000 volts (−15 KV). More preferably, the charge induced on the dielectric material is less than about −12 KV, and even more preferably, less than about −10 KV.

When practicing the embodiment of the invention wherein a negative charge is induced onto the dielectric material, it is important to maintain at least a portion of that charge thereon during the electrostatic spraying process. This can be accomplished by the implementation of a charge maintenance device which is typically: (a) electrically conductive, (b) insulated from direct electrical contact with the negatively-charged dielectric material, and (c) shielded from the positively-charged coating particles, during the spray application step, by the negatively-charged dielectric material.

Any suitable charge maintenance devices can be used when practicing this invention. In one preferred embodiment, the charge maintenance device comprises a grounded or negatively-charged metal plate or probe positioned in close proximity to the dielectric material so that an electrostatic field is created therebetween. In this embodiment, the metal plate or probe typically remains in such a close proximity until the negatively-charged dielectric material has at least some positively-charged coating particles sprayed thereon.

In order to enhance the holding effect of the charge maintenance device employed in accordance with the present invention, such a device preferably has a number of projections extending therefrom. For example, a preferred charge maintenance device has a number of bumps, wires, needle-like projections and/or screw-like projections protruding therefrom. These charge maintenance devices can be made from any suitable material which is electrically conductive. Examples of such suitable materials include: copper, brass, steel, aluminum and/or a combination thereof.

The preferred charge maintenance device depends upon parameters such as the composition and geometric shape of the dielectric material, the distance between the charge maintenance device, the minimum charge need to be held on the dielectric material during the electrostatic spraying process step and the length of time the charge maintenance device needs to hold that minimum charge on the a dielectric material. After taking these and other related parameters in to consideration, those skilled in the art can select the charge maintenance device which best suits their needs.

If the dielectric material is only electrically isolated, as opposed to being negatively-charged or electrically isolated and negatively-charged, a grounding device is preferably employed in accordance with this invention. This grounding device is positioned such that it is in the path of the sprayed, positively-charged coating particles but shielded therefrom by the electrically isolated dielectric material.

When practicing this embodiment of the invention, any suitable grounding device can be used. Typically, the grounding device is: (a) electrically conductive, (b) insulated from direct electrical contact with the dielectric material being coated, and (c) shielded from the charged coating particles, during the spray application step, by the dielectric material being coated.

There are many different grounding devices which can achieve these objectives. Examples of suitable dielectric material grounding devices which can be used include: grounding bars, plates, wires, probes and the like and/or a combination thereof.

These dielectric grounding devices can be made from any suitable material which is electrically conductive. Examples of such suitable materials include: copper, brass, steel, aluminum and/or a combination thereof.

In order for the electrostatic field to be strong enough to deflect and guide the positively-charged paint particles towards the grounded or negatively-charged dielectric material, the potential should preferably be at least about 1,000 volts (1 KV) per centimeter (cm) of air between the end of the spray nozzle and the surface of the article being coated. Preferably, the potential should be at least about 1.5 KV/cm, and even more preferably, at least about 2.0 KV/cm.

The preferred potential depends upon parameters such as: the voltage induced onto the dielectric material, if any, the distance between the tip of the spraying device and the surface of the dielectric material being coated, the rate at which the dielectric material passes through the coating zone, and the velocity at which the particles are sprayed. After taking these and other related parameters in to consideration, those skilled in the an can select the voltage used to induce a positive charge onto the coating particles which best suits their needs.

The novel process of the present invention can be used to electrostatically apply any coating composition which can accept a positive charge. These coating compositions can be in the form of a liquid or a powder. Examples of suitable coatings which can be used when practicing this invention include: gas barrier coating compositions (e.g., $CO_2$ and $O_2$ barrier coatings such as epoxy-amine coatings), color coating compositions, mar resistant coating compositions (e.g., urethane coatings) and the like.

FIGS. 1–7 illustrate one embodiment of the present invention. In this embodiment, hollow containers made from a dielectric material having a dielectric constant less than 4.0 are delivered to an electrostatic coating zone and a curing zone by a transfer system. Such a transfer system generally includes a conveyor for delivering uncoated dielectric containers to a transfer conveyor which is moving in timed relationship to a series of container carrier devices. The carrier devices engage each container by its neck or mouth for carriage through the electrostatic coating and curing zones and for delivery of the coated and cured containers to a discharge conveyor. The carrier devices effectively close the mouth of each container so that the application of the coating, during the electrostatic spraying process, is limited to the exterior surface of the container.

The carrier devices position the containers within the coating zone. While in the coating zone, the carrier devices rotate the containers so as to assure full and uniform coating. After the coating is applied, the containers are carried through a curing oven. The oven may include one or more zones having different curing conditions for temperature and humidity to provide a curing profile particularly suited for the requirements of the various kinds of containers and coating material.

FIG. 1 is a schematic block diagram of a method and apparatus for electrostatically coating dielectric materials in accordance with the present invention. This apparatus includes a conveyor 10. Conveyor 10 receives containers at a loading zone 12. After receiving the containers, conveyor 10 then moves them from the loading zone to an electrostatic coating zone 14. From the coating zone, the conveyor moves the coated containers to a curing zone 16. Thereafter, the cured containers are moved by the conveyer to a discharge zone 18.

Figure 2:
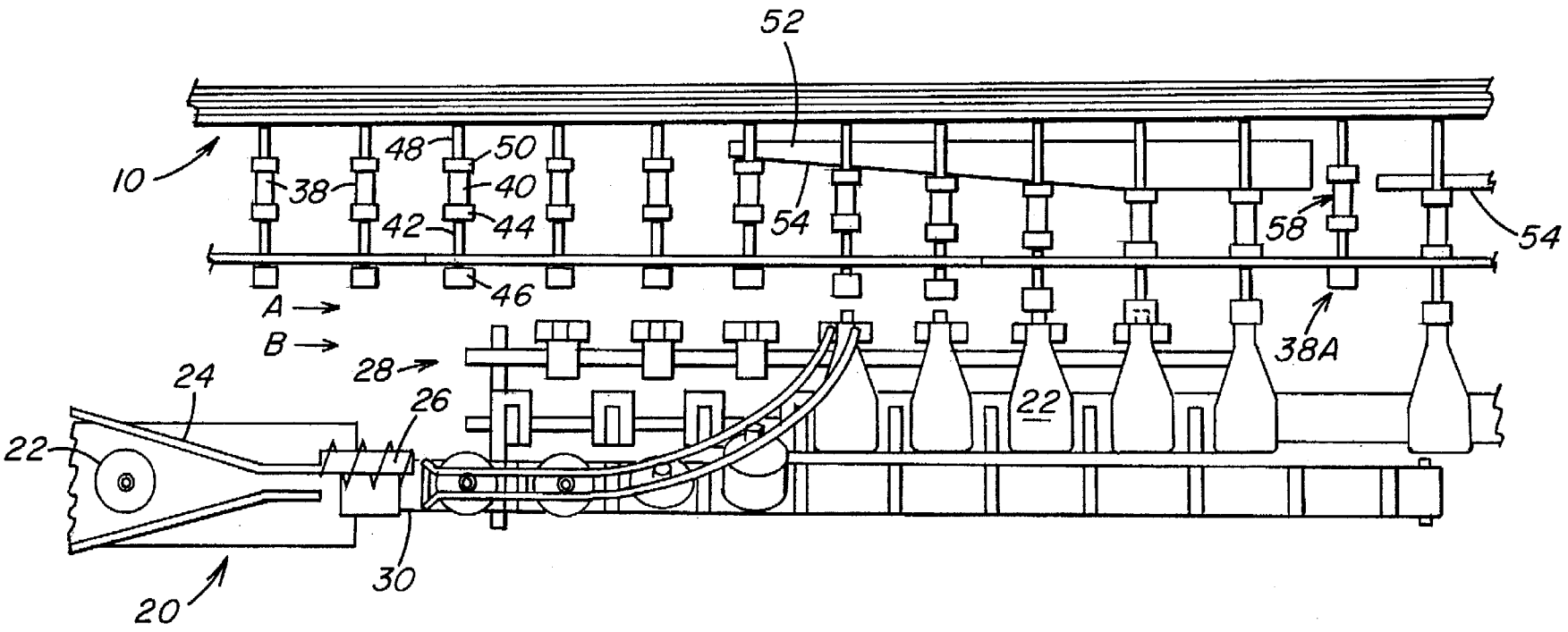
FIG. 2 is a fragmentary plan view of a container transfer system of an electrostatic spraying apparatus.

Any container transfer system can be used when practicing this invention. One example of a suitable container transfer system is described in U.S. Pat. No. 4,625,854. FIG. 2 of this specification illustrates the transfer system described in that patent. As shown in FIG. 2, the transfer system includes an in-feed conveyor 20 for moving containers 22 through an orienting chute 24 to a timing screw 26 and a transfer conveyor 28. The transfer conveyor includes an entry conveyor 30 for receiving individual containers.

The shape and arrangement of these conveyor members is suitable for the container configuration illustrated in FIG. 2. It is to be understood that the configuration of the transfer conveyor may be modified as described to conform with different container configurations. An example of a possible modification is as described in U.S. Pat. No. 4,625,854.

Container carrier conveyor 10 moves in timed relation with transfer conveyor 28 and includes carrier devices 38 for engaging and gripping each container at its open end. Each container carrier device travels in timed and space relationship and along a path A which is parallel to path B traveled by containers in the transfer conveyor. Additionally, the container carrier devices are aligned with individual containers such that each device engages and grips a container by its neck. After the container is securely gripped, the transfer conveyor and carrier conveyor follow diverging paths and the container carrier device carries its container through a subsequent electrostatic coating zone.

Suitable container carriers are described, in detail, in U.S. Pat. No. 4,625,854. For the purpose of this description, it is sufficient to understand that each carrier is typically mounted to conveyor 10, and has an inner housing 40 and an outer housing 42 rotatably mounted to the inner housing at roller joint 44. Each carrier device also includes a chuck 46 for engaging each container at its opened end. Outer housing 42 and chuck 46 are made from a non-conductive or dielectric material so as to minimize the charge induced thereon during the electrostatic spraying process.

In a preferred embodiment, the inner and outer housings are slidable, axially, with respect to their central mounting housing 48. A cam follower 50 provides for this axial movement in cooperation with cam member 52. For loading containers onto carrier devices 38, cam follower 50 engages the surface 54 of cam member 52 and extends the device in an axial direction against the compression force of an internal spring (not shown) located within inner housing 40. As a gripping chuck 46 and container 22 move in timed relation with one another, chuck 46 engages and secures the individual container with which it is aligned. Container holding device 38A is retracted by the force of its internal spring (not shown) through cam gap 58 and follows a separate path since it did not engage a container.

Figure 3:
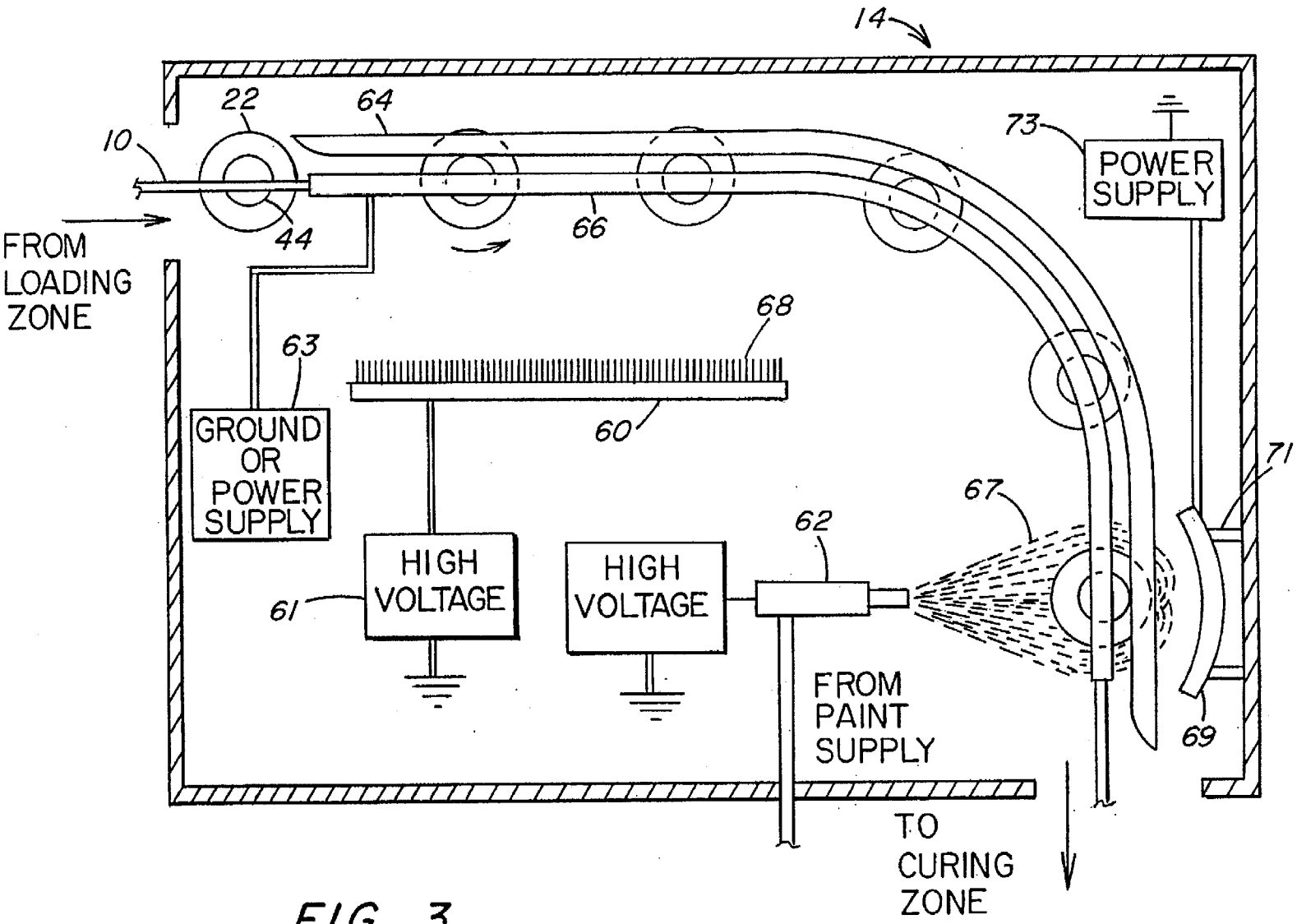
FIG. 3 is a schematic view of an electrostatic spraying zone of an electrostatic spraying apparatus.

FIG. 3 shows a series of containers 22 passing through electrostatic coating zone 14. In the particular embodiment of the invention illustrated in FIG. 3, the dielectric material is electrically isolated and negatively-charged.

Figure 4:
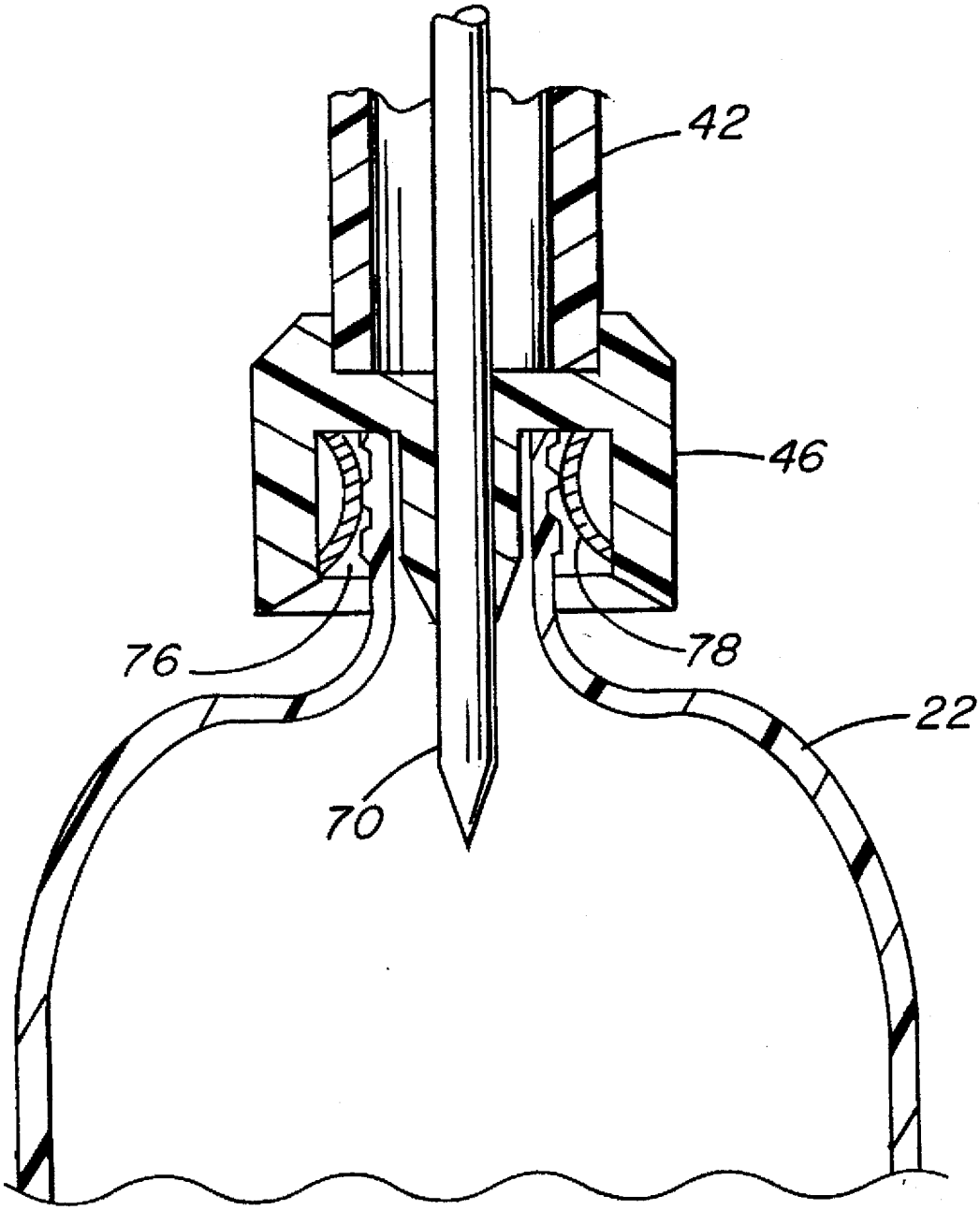
FIG. 4 is a partially cross-sectional view of one embodiment of a container holding device encompassed by the present invention having a dielectric container engaged thereto. In this embodiment, the holding device includes a gripping chuck with a stationary dielectric material charging device, grounding device and/or a charge maintenance device.

As containers 22 are carried into coating zone 14 via conveyor 10, the rotatable joint 44 of the carrier devices engages friction bar 64. Since friction bar 64 is stationary, the bottles begin to rotate. As the bottles rotate, they pass by charging bar 60. Charging bar 60 has distributed over its surfaces a series of elements 68 such as sharp points or fine wires. Moreover, charging bar 60 is connected to voltage source 61 and is insulated from ground so that it can be held at a potential suitable to induce the desired negative charge onto the dielectric containers. After the bottles pass beyond charging bar 60, the charge induced on the bottles is held thereon by a charge maintenance device. One example of such a device is probe 70 which is illustrated in FIG. 4.

Preferably, probe 70 is made from an electrically conductive material. As can be seen, probe 70 is insulated from direct electrical contact with the dielectric material making up container 22 by the chuck 46, which is, itself, made from a dielectric or non-conductive material since an electrical contact therebetween would neutralize the negative charge induced on the container. Such a result is contrary to the objective of this embodiment of the invention. Moreover, since the exposed portion of probe 70 is positioned within the cavity of container 22, it would be shielded from the positively-charged coating particles, during the spray application step, by the negatively-charged container.

Probe 70 can be either grounded or charged negatively. Any suitable means can be used to accomplish this objective. One possible means is illustrated in FIG. 3. There, conveyor 10 has associated therewith bar 66. This bar is made from an electrically conductive material (e.g., copper, brass, steel, aluminum, etc.). Moreover, bar 66 is connected to ground or power supply 63, depending upon whether probe 70 is to be grounded or negatively-charged. Another possible way of grounding probe 70 is to have it electrically connected to the conveyor system which is, itself, typically grounded.

If bar 66 is employed, it is preferably positioned and designed such that an electrical connection is made between it and probe 70 as probe 70 begins to pass by charging bar 60. This electrical connection is preferably maintained until after container 22 is at least partially coated with the positively-charged coating.

In the particular embodiment of the invention illustrated in FIG. 3, as the negative charge is held on container 22 after moving beyond charging bar 60, containers 22 pass in front of electrostatic spraying device 62 which is connected to power source 65. Here, power source 65 enables spraying device 62 to induce a positive charge onto coating particles. These positively-charged coating particles 67 are sprayed into the path of travel of container 22. Preferably, coating particles 67 are sprayed in a direction which is generally perpendicular to the path of travel of container 22.

In accordance with the present invention, the coating is usually atomized by conventional air, airless or rotational techniques. Air and airless electrostatic spray guns typically have a charging electrode provided in the front of the gun which ionizes air as a means of electrically charging the paint. Rotational spray equipment utilizes an electrically charged rotating disk, bell or cone. Atomization in the latter is achieved by a combination of centrifugal and electrostatic forces.

Since, in the embodiment illustrated in FIG. 3 containers 22 are charged negatively as they pass spraying device 62, positively-charged coating particles 67 are drawn thereto. In fact, if the potential between the containers 22 and particles 67 is strong enough, particles 67 may wrap around the backside of containers 22 as shown in FIG. 3. This minimizes overspray and improves transfer efficiency. However, due to limitations such as safety considerations, one may not be able to use the optimum potential either on containers 22 or particles 67 in order to achieve maximum transfer efficiency. One possible solution to this dilemma is to use a positively-charged deflecting panel 69.

Deflecting panel 69 can be made from an electrically conductive material or from a dielectric material which has a dielectric constant greater than that of the dielectric material being coated. Panel 69 is connected to, and electrically isolated from, the coating chamber by insulators 71.

If used, panel 69 should preferably have positive a charge induced thereon. This can be an active charge induced by power source 73. On the other hand, this charge can result from the positive ionized atmosphere created by the charging device which induces a positive charge onto the coating particles. The positive charge induced onto panel 69 should not be such that it either neutralizes the negative charge induced on containers 22, or induces a positive charge thereon, as the containers pass thereby. Since, in a preferred embodiment, the charge on panel 69 and particles 67 is positive, and the charge on containers 22 is negative, oversprayed particles 67 would be repelled from panel 69 towards container 22, thus increasing transfer efficiency.

In a preferred embodiment, the geometric configuration of panel 69 corresponds to that of dielectric material passing thereby. Panel 69 can, however, have any suitable geometric configuration as long as its geometric configuration does not neutralize the negative charge induced on containers 22, or induced a positive charge on containers 22 as they pass thereby.

Referring back to FIG. 3, this invention can also be practiced without the use of charging bar 60 or power source 61. In this latter embodiment, the containers 22 are not negatively-charged prior to being coated by positively-charged coating particles 67. Rather, containers 22 are electrically isolated and have a corresponding grounding device associated therewith. As stated above, any suitable grounding device can be employed as long as it is: (a) electrically conductive, (b) insulated from direct electrical contact with the dielectric material being coated, and (c) shielded from the charged coating particles, during the spray application step, by the dielectric material being coated. One possible example of a suitable grounding device is probe 70 as illustrated in FIG. 4. In this embodiment, probe 70 would be grounded, as opposed to being charged. As the electrically isolated containers with grounding probe 70 pass through coating particles 67, the particles are attracted to the probe. However, since the probe is shielded from the particles by the container, the particles adhere thereto.

In still another embodiment of the present invention, charging bar 60 and power source 61 may be omitted and yet the containers can be negatively-charged. In such an embodiment, bar 66 is connected to power source 63 which is designed to induce a negative charge thereon. Containers 22 have probe 70 passing through their opening as illustrated in FIG. 4. In this embodiment, however, probe 70 is designed such that it contacts bar 66 when passing thereunder. This, in turn, induces a negative charge on the containers 22. Since probe 70 is actively charged until after the container passes through coating particles 67, in this embodiment, probe 70 serves as not only the means for negatively charging the dielectric material, but also the means for maintaining the negative charge thereon. See, e.g., FIGS. 6 and 7 for one method of electrically connecting a probe with bar 66 without having to charge the entire conveyor system and without adversely affecting the movement of the supported containers by a conveyor system.

Figure 5:
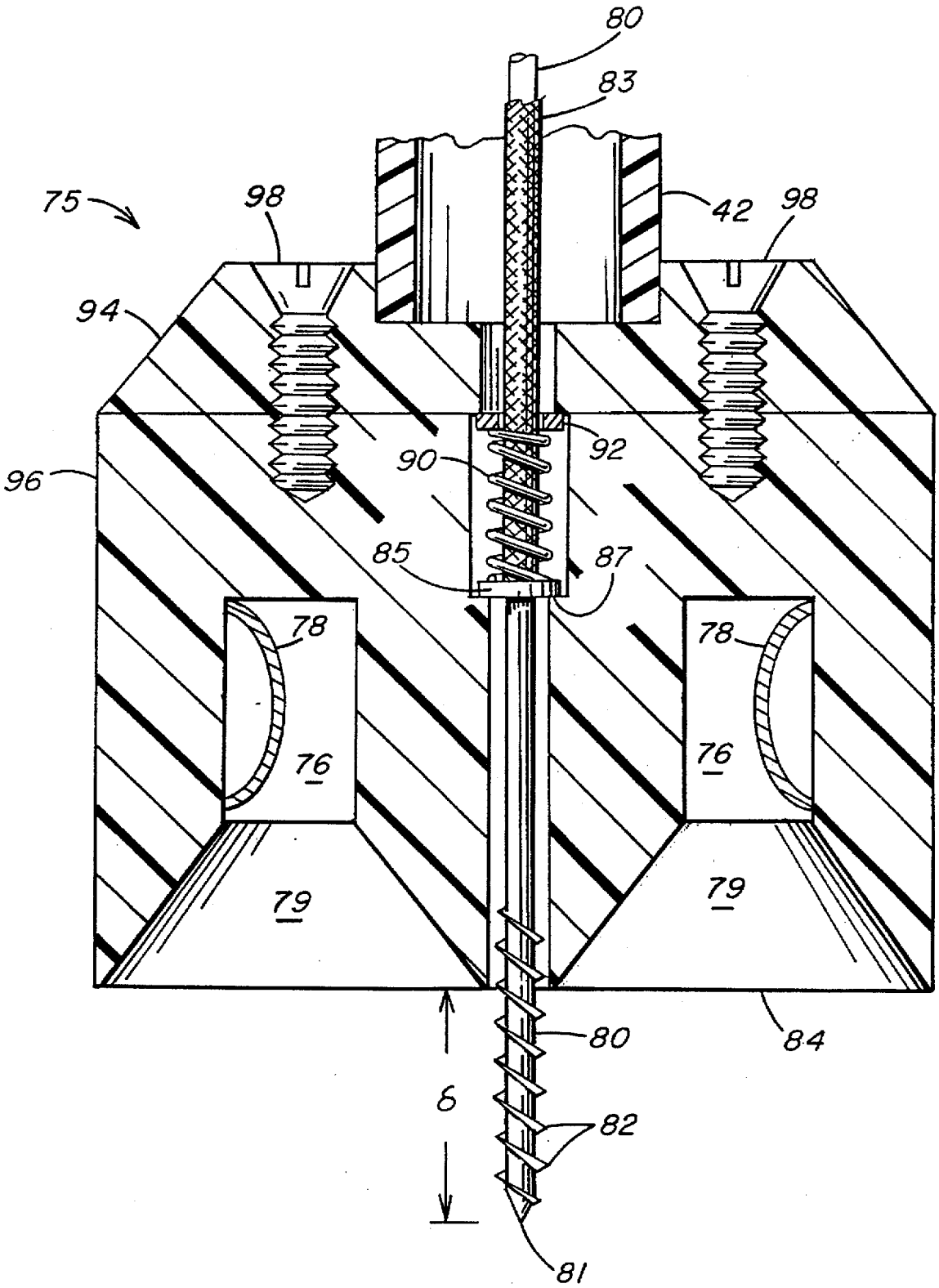
FIG. 5 is a partially cross-sectional view of another embodiment of a container holding device encompassed by the present invention. In this embodiment, the holding device includes gripping chuck with a retractable dielectric material charging device, grounding device, and/or a charge maintenance device.

FIG. 5 is a partially cross-sectional view of another embodiment of a container holding device encompassed by the present invention. In this embodiment, the holding device includes a gripping chuck 75 which has a retractable dielectric material charging, grounding and/or charge maintenance device associated therewith. In this FIGURE, one end of chuck 75 is connected to housing 42, while its other end is provided with an annular recess 76 dimensioned to receive the neck portion of a dielectric container which is to be electrostatically coated.

It is preferred that chuck 75 not have a negative charge thereon which is greater than, or substantially equal to, the negative charge on the dielectric material attached thereto during the spray application step, since this would tend to draw positively-charged coating particles towards the chuck as well as the dielectric material, thus reducing transfer efficiency. Accordingly, chuck 75 is preferably made from a non-conductive or dielectric material (e.g., plastics). However, if chuck 75 is made from a conductive material (e.g., metals), it should preferably be: (a) coated with a non-conductive or dielectric material (e.g., polytetrafluoroethylene), and (b) electrically insulated from the container or the probe, or both.

Retention springs 78 are mounted within recess 76 of chuck 75. These springs are designed to exert a gripping pressure onto the exterior surface of a container's neck portion when it is introduced into recess 76 of chuck 75 (see, e.g., FIG. 4). If used retention springs 78 can be made of any type of material which has the proper durability and resiliency (e.g., stainless steel, plastics, etc.). Preferably, the retention springs should not draw a significant amount of the positively-charged particles thereto during the spray application process. Accordingly, if they are made from an electrically conductive material, it is preferred that they be shielded from the positively-charged coating particles and/or not be grounded.

Notwithstanding the above, retention springs 78 can be eliminated completely or replaced by other types of retention devices. The preferred retention device, if any, depends upon whether, or how, the containers are to be secured to chuck 75 during the electrostatic spray application process. For example, in the embodiment illustrated in FIG. 5, a container can be held in an upright manner by merely sliding its neck portion into recess 76. This type of configuration is especially useful for high speed and high volume production lines (e.g., production lines for electrostatically coating carbonated beverage containers). On the other hand, retention springs 78 can be eliminated and replaced by a thread design (not shown) formed on the outside wall surface of recess 76. This configuration may be used if it is desirable to secure the container to chuck 75 by screwing the two together. Yet another possible option is to have no retention means at all. For example, chuck 75 can be inverted so that the force of gravity holds the container within recess 76 of chuck 75.

In the embodiment illustrated in FIG. 5, chuck 75 also has a probe 80 passing through its center which has a point 81 at its one end, however, unlike probe 70 which is illustrated in FIG. 3, probe 80 has screw-like projections 82 protruding from its sides. Moreover, at least a portion of probe 80 is covered by an electrically insulating covering 83.

Point 81 and projections 82 enhance the ability of probe 80 to hold the charge on a negatively-charged dielectric material attached to chuck 75, or to induce a negative charge thereon, depending upon whether probe 80 is being used as a dielectric material charge maintenance means or charging means.

The pointed end 81 of probe 80 extends beyond the bottom edge 84 of chuck 75 a distance δ. Typically, the application of positively-charged coating particles onto the exterior walls of the grounded or negatively-charged container are more so concentrated to those areas on the container which lie in a plane beyond the point. Therefore, optimum distance δ depends, in part, upon which areas of the container need to be coated. This distance also depends, in part, upon the geometric configuration of the probe and the container which is to be attached to chuck 75. If there is a desire to coat as much of the container as possible, and if the probe has a pointed end such as pointed end 81, probe 80 preferably extends only slightly past the bottom edge 84 of chuck 75.

The embodiment illustrated in FIG. 5 is designed to provide a margin of error when attempting to align the neck of a dielectric container with recess 76. There, chuck 75 has a frustoconically-shaped recess 79 whose narrow end leads into recess 76. Moreover, probe 80 is designed such that it can at least partially retract into chuck 75 to minimize any damage to the dielectric container if, during the process wherein the container is being fitted into recess 76, the neck portion of the container contacts probe 80.

In the embodiment illustrated in FIG. 5, probe 80 has a washer-like projection 85 attached thereto. The lower surface of projection 85 rests upon a ledge 87 formed in the body of chuck 75. A spring 90 is fitted over probe 80 such that the spring's lower end rests on the upper surface of projection 85. The upper end of spring 90 rests against the lower surface of washer 92 which is also fitted over probe 80. Probe 80 is free to move through the center opening of washer 92. Notwithstanding the above, any suitable design can be used to have at least a portion of probe 80 retract into chuck 75. This is an optional feature of the present invention.

To facilitate the manufacture of chuck 75, it is shown in FIG. 5 as having a upper portion 94 and a lower portion 96. Upper portion 94 is secured to lower portion 96 by screws 98. Screws 98 are preferably either made from a non-conductive or dielectric material or are covered by such so as to minimize the attraction of positively-charged coating particles thereto during the electrostatic spraying process.

Figure 6:
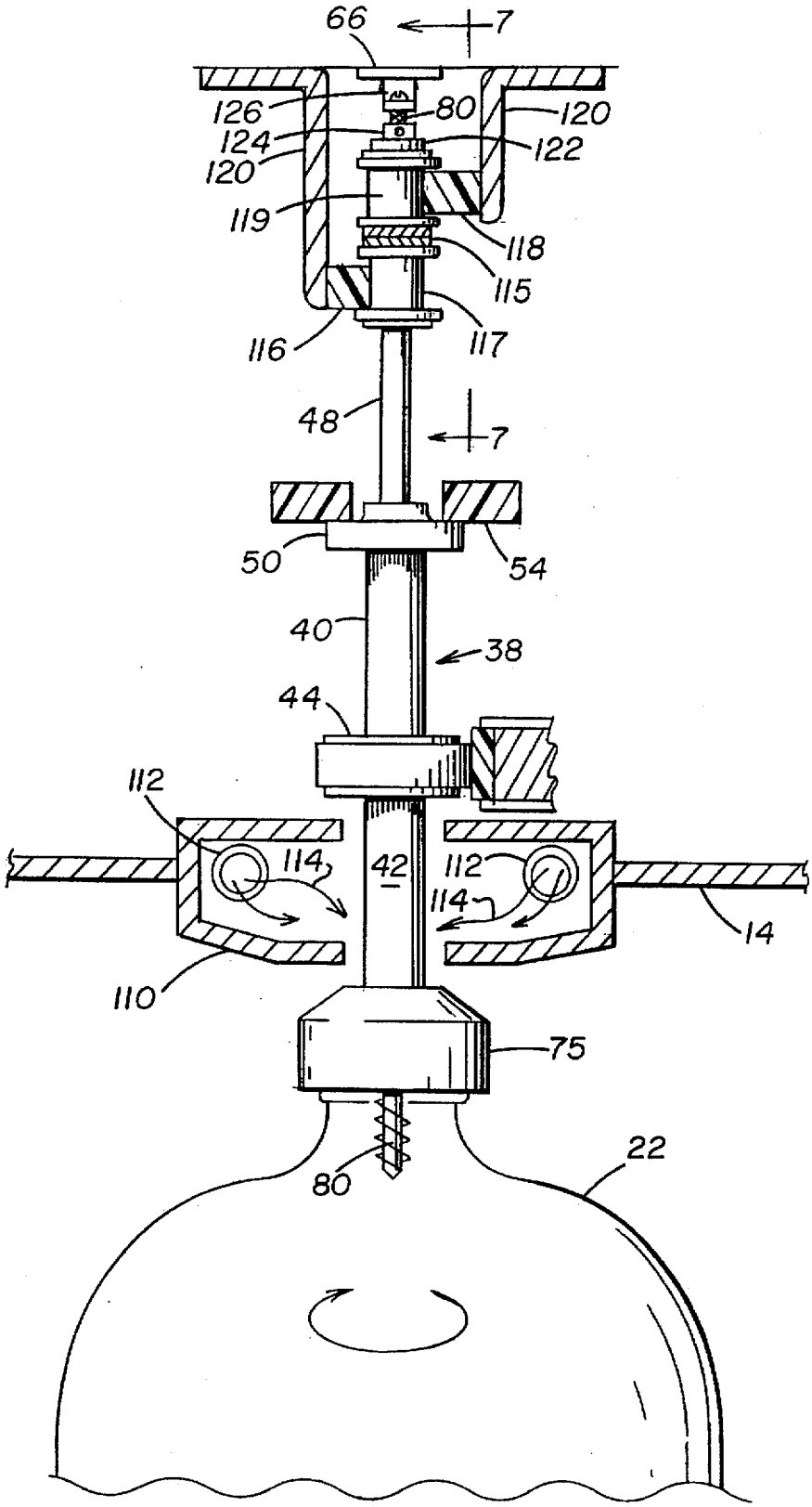
FIG. 6 is a partially cross-sectional view of a container holding device as it carries a dielectric container through an electrostatic spraying chamber in accordance with the present invention. In this FIGURE, the holding device's gripping chuck is that which is illustrated in FIG. 5.

FIG. 6 illustrates the position and operation of a container holding device which has received a container and is traveling along an active path in engagement with cam surfaces 54. In FIG. 6, the device 38 has positioned container 22 within a coating chamber 14 to receive positively-charged coating particles. The position of the container within the chamber is determined by location of cam surfaces 54 acting on cam follower 50. The outer housing 42 and container 22 are rotated as they pass through coating chamber 14. Such container rotation is desirable for the following reasons: to assure even reception of the coating by the container during spraying, to prevent dripping or sagging of coating during spraying, and to prevent dripping or sagging of the coating before it is cured.

It will be observed that, by virtue of the neck gripping of the container, most of the container's entire outer surface is available for reception of the positively-charged coating. Additionally the neck of the container and the container's interior surfaces are shielded from the positively-charged coating which is a desirable feature in many instances, especially those wherein the container is used to hold beverages.

In the embodiment illustrated in FIG. 6, antechamber 110 houses pipes 112 which direct a water mist 114 into coating chamber 14 to achieve desired humidity levels in the chamber and to prevent the positively-charged coating particles from entering the antechamber. This practice is preferred when it is necessary to control humidity levels in the coating chamber.

In FIG. 6, the container holding device 38 is drawn through the coating chamber by chain 115. Holding device 38 is supported from rails 116 and 118 which are attached to brackets 120. Bushings 117 and 119 ride along rails 116 and 117, respectively.

When the container holding device 38 is inactive (i.e., it has not received a container from the transfer conveyor), the device is retracted with chuck 75 traveling within the antechamber 110 without rotation. As such, the amount of positively-charged coating particles which are attracted to chuck 75 is minimized.

Figure 7:
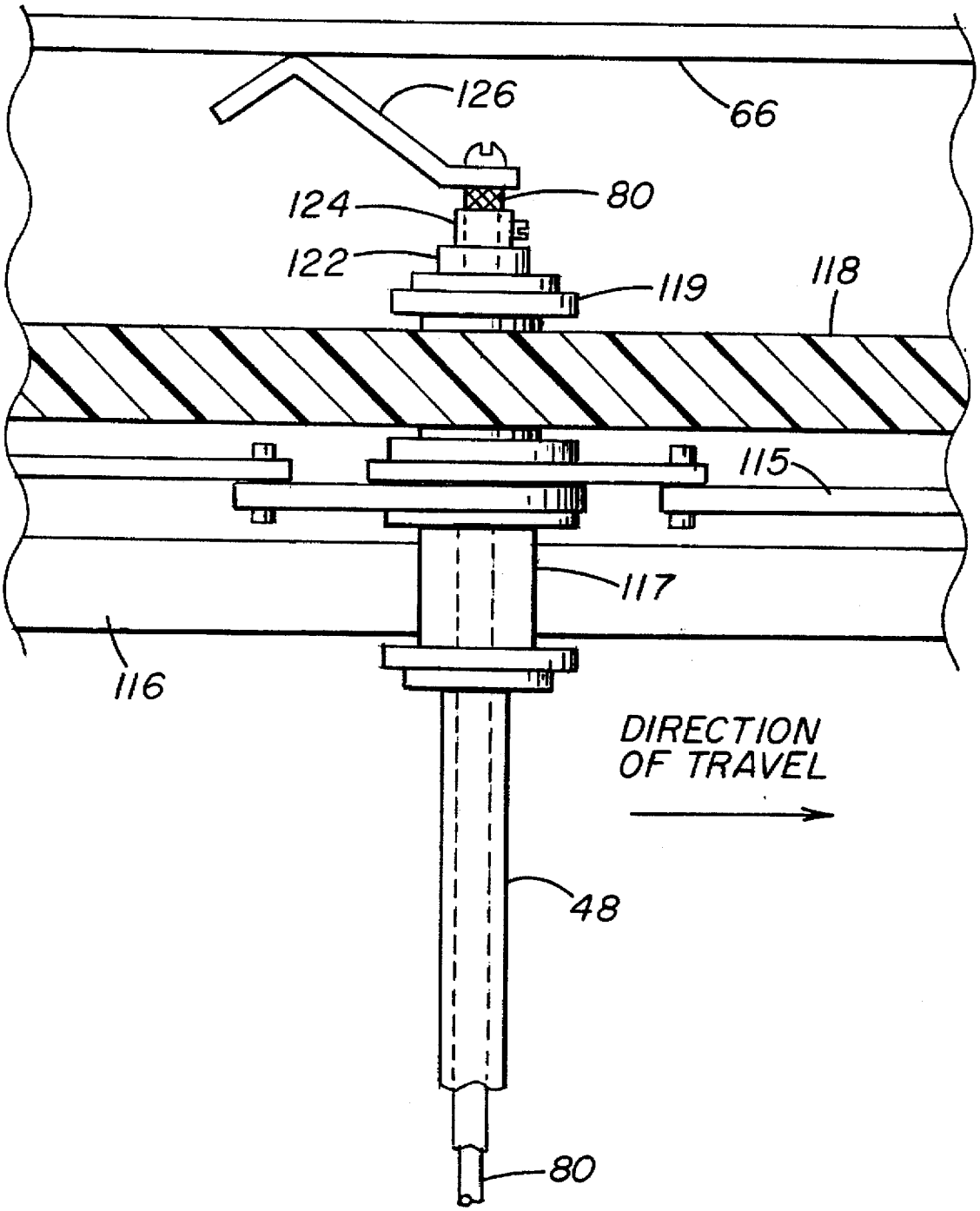
FIG. 7 is a partially cross-sectional view of the container holding device illustrated in FIG. 6 taken along line 7—7. This FIGURE illustrates one method of charging or grounding a dielectric material charging, grounding, and/or charge maintenance device which is encompassed by the present invention.

In the embodiment of the invention wherein holding device retracts when it does not engage a container, probe 80 has a telescopic design as illustrated in FIG. 7. This permits the probe to collapse onto itself, when holding device 38 is inactive.

FIG. 7 is a partially cross-sectional view of the container holding device illustrated in FIG. 6 taken along line 7—7. FIG. 7 illustrates one means for charging or grounding probe 80. Specifically, in this embodiment, probe 80 passed through a corresponding opening defined in housing 48 and bushings 117 and 119. An electrically insulating washer 122 separates locking ring 124 from bushing 119. One end of a connecting bar 126 is screwed into the end of probe 80. The other end of connecting bar 126 contacts bar 66. As stated earlier, bar 66 can be either grounded or charged negatively. If bar 66 is grounded, so will the tip 81 of probe 80 when holding device 38 is positioned such that connecting bar 126 comes into contact therewith. Similarly, if bar 66 is charged negatively, so will the tip 81 of probe 80 when holding device 38 is positioned such that connecting bar 126 comes into contact therewith.

As stated earlier, it is not necessary to use bar 66 in order to practice this invention. For example, if it is desired to ground probe 80 in the embodiment illustrated in FIG. 6, electrically insulating washer 122 can be replaced by a metal washer or eliminated. Under either of these circumstances, locking ring 124 would be electrically connected to bushing 119 which is, itself, grounded. Due to this electrical connection, probe 80 will also be grounded.

EXAMPLES

The examples which follow are intended to assist in a further understanding of this invention. Particular materials employed, species and conditions are intended to be illustrative of the invention.

Example I

This example demonstrates the preparation of coating compositions which were used in subsequent examples.

A first coating composition was prepared by stirring together the following material: 73.3 weight percent of a tetraethyl pentamine/EPON 880 adduct (EPON 880 is 4,4'-Isopropylidenediphenol/epichlorohydrin available from Shell Oil Co.), 12.8 weight percent of DOWANOL®PM (1-methoxy-2-propanol commercially available from Dow Chemical Company), 0.1 weight percent SF-1023 silicone surfactant from General Electric, 1.7 weight percent of 2 butoxy ethanol, 10.6 weight percent of toluene, and 1.5 weight percent of deionized water. The resulting homogeneous blend is hereinafter referred to as "Component 1A." All aforementioned weight percentages are based on the total weight of all components in Component 1A.

Then, 52.5 weight percent of EPON 880, and 47.5 weight percent of DOWANOL®PM were stirred together. The resulting homogeneous blend is hereinafter referred to as "Component 1B." All aforementioned weight percentages are based on the total weight of all components in Component 1B. %.

Components 1A and 1B were blended together at a ratio of 5:1 by volume. The resulting homogeneous blend was permitted to stand at room temperature for about one hour. This blend, which is hereinafter referred to as "Coating 1."

A second coating composition was prepared by stirring together the following material: 23.47 weight percent GASKAMINE®328S (a reaction product of metaxylylenediamine and epichlorohydrin commercially available from Mitsubishi Gas Company), 72.75 weight percent of DOWANOL®PM (1-methoxy-2-propanol commercially available from Dow Chemical Company), 0.10 weight percent SF-1023 silicone surfactant from General Electric, 2.43 weight percent of cyclohexyl alcohol (with 2% water), and 1.25 weight percent of deionized water. The resulting homogeneous blend is hereinafter referred to as "Component 2A." All aforementioned weight percentages are based on the total weight of all components in Component 2A.

Then, 75.0 weight percent of DEN-444 (an epoxy novolac resin having a glycidyl functionality of 3.6, commercially available from Dow Chemical Co.), and 25.0 weight percent of methyl ethyl ketone were stirred together. The resulting homogeneous blend is hereinafter referred to as "Component 2B." All aforementioned weight percentages are based on the total weight of all components in Component 2B.

Components 2A and 2B were blended together at a ratio of 3:1 by volume. The resulting homogeneous blend was permitted to stand at room temperature for about one hour. This blend, which is hereinafter referred to as "Coating 2."

Example II

This example demonstrates the effect of charge polarity on the application of a coating composition onto a dielectric container which has dielectric constant of less than 4.0. In this example, a charge was not induced onto the bottle. Moreover, a grounding device such as a probe was not used inside the bottle.

The coating composition which was applied was Coating 1 from Example 1. The dielectric material onto which the coating was applied was a 330 milliliter polyethylene terephthalate (PET) bottle having a diameter of about 8 centimeters and a length of about 14 centimeters. PET has a dielectric constant of about 3.25.

The means of applying the coating onto the bottle was a Ransburg 6 inch (15 centimeter) Conical Disc spinning at about 16,000 revolutions per minute (rpm). The fluid delivery rate was about 640 grams per minute. The distance between the bottle's exterior surface and the end of the disc was approximately 10 centimeters.

In the first spray application process of this example, a negative 90 KV charge was placed on the disc of the spray gun. A first bottle was weighed and then drawn, by a conveyor at a speed of approximately 15 meters per minute (50 feet per minute), through the negatively-charged coating particles emitted from the disc. As the first bottle was being drawn through the atomized coating, it was being rotated. Thereafter, the first bottle was weighed to determine that the weight of coating thereon was 0.11 grams.

Next, in the second spray application process of this example, a positive 90 KV charge placed on the disc of the spray gun. A second bottle was weighed and then drawn through the positively-charged coating particles at the same rate that the first bottle was drawn through the negatively-charged coating particles. As the second bottle was being drawn through the atomized coating, it was being rotated at the same rate as that at which the first bottle was being rotated. Thereafter, the second bottle was weighed to determine that the weight of coating thereon was 0.17 grams.

This Examples shows that the percentage of a coating composition being electrostatically applied to a dielectric material which has a dielectric constant of less then 4.0 is about 54% greater when the coating is charged positively, as opposed to negatively.

Example III

This example demonstrates the effect of charge polarity on the application of a coating composition onto a dielectric container which has dielectric constant of less than 4.0, as well as the effect of using a grounding device. In this example, a charge was not induced onto the bottle. In some instances, however, a grounding probe was used. The bottles were held by a gripping chuck which was similar to that illustrated in FIG. 4.

In those instances where a probe was used, it was a circular wire brush wherein the diameter of the brush's bristle portion was about 2.5 centimeters, and wherein the length of the brush's bristle portion was about 6 centimeters. The probe was inserted through the opening and into the cavity of the bottles such that the brush's bristle portion was centered laterally and longitudinally.

The coating composition which was applied was Coating 2 from Example 1. The dielectric material onto which the coating was applied was a 330 milliliter PET bottle having a diameter of about 8 centimeters and a length of about 14 centimeters.

The means of applying the coating onto the bottles was a Ransburg Electrostatic Spray Gun (Model 3). The fluid delivery rate was about 160 cubic centimeters per minute.

The distance between the bottle's exterior surface and the end of the gun was approximately 10 centimeters.

In this example, the transfer efficiency of a spray application process was calculated by dividing the weight of the coating actually applied onto the bottle by the weight of the coating emitted from the spray gun during the process. The transfer efficiencies of all process performed in this example are set out in TABLE 1.

In the first spray application process of this example, no charge was placed on the spray gun. A number of bottles were individually weighed and drawn in series by a conveyor system through a zone of positively-charged coating particles. The conveyor was moving the bottles at a speed of approximately 15 meters per minute (50 feet per minute). The horizontal space between the bottles was approximately 1.5 centimeters. The relative humidity (RH) during this spray application process was about 32%.

As the bottles were being drawn through the atomized coating, they were rotated. Thereafter, the bottles were individually weighed to determine the transfer efficiency of this particular spray application process. This same process was then repeated at 45% RH and 63% RH. The transfer efficiency for the runs at 32% RH, 45% RH and 63% RH was 56, 55 and 54 percent, respectively. Accordingly, the average transfer efficiency for this spray application process was 55.

In the second spray application process of this example, a negative 90 KV charge was placed on the spray gun. Other than this difference, the coating procedure was the same as the first spray application process of this example. The transfer efficiency for this second spray application process at 32% RH, 45% RH and 63% RH was 52, 57 and 58, respectively. Accordingly, the average transfer efficiency for this spray application process was 59 percent.

In the third spray application process of this example, a positive 90 KV charge was placed on the spray gun. Other than this difference, the coating procedure was the same as the first spray application process of this example. The transfer efficiency for this third spray application process at 32% RH, 45% RH and 63% RH was 60, 57 and 61 percent, respectively. Accordingly, the average transfer efficiency for this spray application process was 62 percent.

In the fourth spray application process of this example, a negative 90 KV charge was placed on the spray gun, and a grounded wire brush probe was inserted into the bottle's opening. Other than these differences, the coating procedure was the same as the first spray application process of this example. The transfer efficiency for this third spray application process at 32% RH, 45% RH and 63% RH was 50, 63 and 57 percent, respectively. Accordingly, the average transfer efficiency for this spray application process was 57 percent In the fifth spray application process of this example, a positive 90 KV charge was placed on the spray gun, and a grounded wire brush probe was inserted into the bottle's opening. Other than these differences, the coating procedure was the same as the first spray application process of this example. The transfer efficiency for this third spray application process at 32% RH, 45% RH and 63% RH was 76, 74 and 89 percent, respectively. Accordingly, the average transfer efficiency for this spray application process was 80 percent.

TABLE 1

| Spray Process of Example III | Gun Charge (KV) | Electrostatic Aid | Transfer Efficiency (%) 32% RH | 45% RH | 63% RH | Average Transfer Efficiency (%) |
|---|---|---|---|---|---|---|
| First (Control) | 0 | NONE | 56 | 55 | 54 | 55 |
| Second | 90– | NONE | 52 | 57 | 58 | 55 |
| Third | 90+ | | 60 | 57 | 61 | 61 |
| Fourth | 90– | PROBE | 50 | 63 | 57 | 57 |
| Fifth | 90+ | | 76 | 74 | 89 | 80 |

As can be seen from Table 1, the transfer efficiency greatly improved by merely electrostatically applying a positively-charged coating composition. The data also shows that the percent transfer efficiency was even further improved by employing a grounding device in conjunction with charging the coating composition positively. On the other hand, the transfer efficiency decreased when a negatively-charged coating composition was electrostatically applied onto the bottles.

Example IV

This Example demonstrates the effect of charge polarity on the application of a coating composition onto a dielectric container which has dielectric constant of less than 4.0 and on the dielectric container, itself, as well as the effect of using a grounding device.

The coating composition which was applied was Coating 1 from Example 1. The dielectric material onto which the coating was applied was a 330 milliliter PET bottle having a diameter of about 8 centimeters and a length of about 14 centimeters. The means of applying the coating onto the bottle was a Ransburg 30 mm Microbell Spray Gun. The distance between the bottle's exterior surface and the end of the disc was approximately 10 centimeters.

The bottles were held by a gripping chuck which was similar to that illustrated in FIG. 4. Moreover, the coating zone was similar to that illustrated in FIG. 3.

In those instances where a probe was used, it was a circular wire brush wherein the diameter of the brush's bristle portion was about 2.5 centimeters, and wherein the length of the brush's bristle portion was about 6 centimeters. The probe was inserted through the opening and into the cavity of the bottles such that the brush's bristle portion was centered laterally and longitudinally.

In this example, the efficiency of a particular coating process was determined by weighing the amount of coating applied onto the bottles. This data is set out in TABLE 2.

In the first spray application process of this example, a negative 90 KV charge was placed on the spray gun, and no charge was placed on the bottle. The bottle was weighed and then drawn, by a conveyor at a speed of approximately 15 meters per minute (50 feet per minute), through the negatively-charged coating particles emitted from the gun. The relative humidity (RH) during this spray application process was about 32%.

As the bottle was being drawn through the atomized coating, it was being rotated. Thereafter, the bottle was weighed to determine that the weight of coating thereon was 0.08 grams.

In the second spray application process of this example, a positive 90 KV charge was placed on the spray gun. Other than this difference, the coating procedure was the same as the first spray application process of this example. The weight of coating applied onto the bottle during this application process was 0.09 grams.

In the third spray application process of this example, a negative 90 KV charge was placed on the spray gun, and a negative 5 KV charge was induced onto the bottle with a negatively-charged charging bar. Other than these differences, the coating procedure was the same as the first spray application process of this example. The weight of coating applied onto the bottle during this application process was 0.08 grams.

In the fourth spray application process of this example, a positive 90 KV charge was placed on the spray gun, and a negative 5 KV charge was induced onto the bottle with a negatively-charged charging bar. Other than these differences, the coating procedure was the same as the first spray application process of this example. The weight of coating applied onto the bottle during this application process was 0.1 grams.

In the fifth spray application process of this example, a negative 90 KV charge was placed on the spray gun, and a positive 5 KV charge was induced onto the bottle with a positively-charged charging bar. Other than these differences, the coating procedure was the same as the first spray application process of this example. The weight of coating applied onto the bottle during this application process was 0.09 grams.

In the sixth spray application process of this example, a positive 90 KV charge was placed on the spray gun, and a positive 5 KV charge was induced onto the bottle with a positively-charged charging bar. Other than these differences, the coating procedure was the same as the first spray application process of this example. The weight of coating applied onto the bottle during this application process was 0.07 grams.

In the seventh spray application process of this example, a negative 90 KV charge was placed on the spray gun, no charge was induced onto the bottle, and a probe was inserted into the bottle's opening. Other than these differences, the coating procedure was the same as the first spray application process of this example. The weight of coating applied onto the bottle during this application process was 0.39 grams.

In the eighth spray application process of this example, a positive 90 KV charge was placed on the spray gun, no charge was induced onto the bottle, and a probe was inserted into the bottle's opening. Other than these differences, the coating procedure was the same as the first spray application process of this example. The weight of coating applied onto the bottle during this application process was 0.57 grams.

In the ninth spray application process of this example, a negative 90 KV charge was placed on the spray gun, a negative 5 KV charge was induced onto the bottle with a negatively-charged charging bar, and a probe was inserted into the bottle's opening. Other than these differences, the coating procedure was the same as the first spray application process of this example. The weight of coating applied onto the bottle during this application process was 0.22 grams.

In the tenth spray application process of this example, a positive 90 KV charge was placed on the spray gun, a negative 5 KV charge was induced onto the bottle with a negatively-charged charging bar, and a probe was inserted into the bottle's opening. Other than these differences, the coating procedure was the same as the first spray application process of this example. The weight of coating applied onto the bottle during this application process was 0.73 grams.

In the eleventh spray application process of this example, a negative 90 KV charge was placed on the spray gun, a positive 5 KV charge was induced onto the bottle with a positively-charged charging bar, and a probe was inserted into the bottle's opening. Other than these differences, the coating procedure was the same as the first spray application process of this example. The weight of coating applied onto the bottle during this application process was 0.59 grams.

In the twelfth spray application process of this example, a positive 90 KV charge was placed on the spray gun, a positive 5 KV charge was induced onto the bottle with a positively-charged charging bar, and a probe was inserted into the bottle's opening. Other than these differences, the coating procedure was the same as the first spray application process of this example. The weight of coating applied onto the bottle during this application process was 0.33 grams.

TABLE 2

| Spray Process of Example IV | Gun Charge (KV) | Bottle Charge (KV) | Electrostatic Aid | Weight of Coating (g) |
|---|---|---|---|---|
| First | 90– | 0 | NONE | 0.08 |
| Second | 90+ | 0 | NONE | 0.09 |
| Third | 90– | 5– | NONE | 0.08 |
| Fourth | 90+ | 5– | NONE | 0.1 |
| Fifth | 90– | 5+ | NONE | 0.09 |
| Sixth | 90+ | 5+ | NONE | 0.07 |
| Seventh | 90– | 0 | PROBE | 0.38 |
| Eighth | 90+ | 0 | PROBE | 0.57 |
| Ninth | 90– | 5– | PROBE | 0.22 |
| Tenth | 90+ | 5– | PROBE | 0.73 |
| Eleventh | 90– | 5+ | PROBE | 0.59 |
| Twelfth | 90+ | 5+ | PROBE | 0.33 |

As can be seen from Table 2, the weight of the coating deposited onto the dielectric container increased by merely electrostatically applying a positively-charged coating composition. The data also shows that the weight of the coating deposited onto the dielectric container significantly increased by employing a grounding device in conjunction with charging the coating composition positively. On the other hand, the weight of the coating deposited onto the dielectric container decreased when a negatively-charged coating composition was electrostatically applied.

It is evident from the foregoing that various modifications, which are apparent to those skilled in the art, can be made to the embodiments of this invention without departing from the spirit or scope thereof. Having thus described the invention, it is claimed as follows.

That which is claimed is:

1. A process for electrostatically applying a coating composition onto a dielectric material comprising:

(a) inducing a positive charge onto a coating composition, (b) spraying the positively charged coating composition with a spraying device to form a field of positively-charged coating particles, (c) inducing a negative charge of less than 10,000 volts onto a dielectric material having a dielectric constant less than 4.0 with a negative charging source which creates a negatively-ionized atmosphere through which the dielectric material passes, (d) holding at least a portion of the negative charge on the negatively-charged dielectric material, after the negatively-charged dielectric material has passed through the negatively-ionized atmosphere, with a charge maintenance device which is:

i. electrically grounded and conductive, ii. insulated from direct electrical contact with the negatively-charged dielectric material, and iii. shielded from the field of positively-charged coating particles by the negatively-charged dielectric material, and (e) passing the negatively-charged dielectric material through the field of positively-charged coating particles so as to apply said positively-charged coating particles onto said negatively-charged dielectric material.

2. A process as recited in claim 1 wherein the dielectric material has a dielectric constant less than 3.8.

3. A process as recited in claim 1 wherein the dielectric material is selected from the group consisting of fused silica, methylmethacrylate, polycarbonate, polyvinyl chloride, polyvinyl acetate, polyethylene terephthalate, polystyrene, polyethylene, polypropylene and polytetrafluoroethylene, polyethylene naphthalate, and mixtures thereof.

4. A process as recited in claim 3 wherein the dielectric material is selected from the group consisting of polyethylene terephthalate, polyethylene, polyethylene naphthalate, and polypropylene.

5. A process as recited in claim 1 wherein the dielectric material is in the form of a container having an opening which leads into a cavity, and wherein the charge maintenance device is inserted through the container's opening into the container's cavity.

6. A process as recited in claim 5 wherein the charge maintenance device is a grounded metal probe.

7. A process as recited in claim 1 wherein the negative charge induced onto the dielectric material, prior to having any of the positively-charged coating composition applied thereon, is at least about −100 volts.

8. A process as recited in claim 1 wherein the negative charge maintained on the dielectric material, while positively-charged coating composition is being applied thereon, is at least about −100 volts.

9. A process as recited in claim 1 wherein the negative charge on the dielectric material is at least partially induced by a charging source which is in direct electrical contact with the dielectric material before positively-charged coating composition is applied thereon.

10. A process as recited in claim 1 further comprising deflecting at least a portion of the positively-charged coating particles onto the negatively-charged dielectric material while the negatively-charged dielectric material is passing through the field of positively-charged coating particles by a positively-charged deflecting device positioned such that the negatively-charged dielectric material is located between the spraying device and the positively-charged deflecting device.

11. A process as recited in claim 1 wherein the coating composition is selected from those which can accept a positive charge.

12. A process as recited in claim 1 wherein the coating composition is a gas barrier coating composition.

13. A process as recited in claim 12 wherein the gas barrier coating composition is an epoxy-amine coating composition.

14. A process as recited in claim 1 wherein steps (a) and (b) occur simultaneously.

* * * * *